US010844864B2

(12) United States Patent
Milner

(10) Patent No.: US 10,844,864 B2
(45) Date of Patent: Nov. 24, 2020

(54) VACUUM PUMP

(71) Applicant: Edwards Limited, Burgess Hill (GB)

(72) Inventor: Paul Milner, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 14 days.

(21) Appl. No.: 16/323,905

(22) PCT Filed: Aug. 2, 2017

(86) PCT No.: PCT/GB2017/052244
§ 371 (c)(1),
(2) Date: Feb. 7, 2019

(87) PCT Pub. No.: WO2018/029446
PCT Pub. Date: Feb. 15, 2018

(65) Prior Publication Data

US 2019/0170146 A1 Jun. 6, 2019

(30) Foreign Application Priority Data

Aug. 8, 2016 (GB) ..... 1613576.6

(51) Int. Cl.
*F04D 19/04* (2006.01)
*F04D 29/02* (2006.01)
(Continued)

(52) U.S. Cl.
CPC ..... *F04D 19/04* (2013.01); *F04D 19/042* (2013.01); *F04D 19/046* (2013.01); *F04D 29/02* (2013.01);
(Continued)

(58) Field of Classification Search
CPC ..... F04D 19/04; F04D 29/023; F04D 19/046; F04D 29/542; F04D 19/042;
(Continued)

(56) References Cited

U.S. PATENT DOCUMENTS 5,052,887 A 10/1991 Novikov et al.
6,332,752 B2 * 12/2001 Ikegami ..... F04D 27/008 415/90
(Continued)

FOREIGN PATENT DOCUMENTS

CN 1037195 A 11/1989
CN 1039088 A 1/1990
(Continued)

OTHER PUBLICATIONS

British Search Report dated Feb. 10, 2017 and Examination Report dated Feb. 13, 2017 for corresponding British Application No. GB1613576.6.
(Continued)

*Primary Examiner* — Eldon T Brockman
(74) *Attorney, Agent, or Firm* — Theodore M. Magee; Westman, Champlin & Koehler, P.A.

(57) ABSTRACT

Turbomolecular stator components include an array of stator blades, arranged to interact with pumped gases. Spacers are used to locate the stator blade array and couple the stator blade array to a housing. The stator components include an outer section that is resilient and arranged to cooperate with the spacers.

8 Claims, 3 Drawing Sheets

(51) Int. Cl.
*F04D 29/54* (2006.01)
*F04D 29/64* (2006.01)
*F04D 29/52* (2006.01)

(52) U.S. Cl.
CPC ..... *F04D 29/023* (2013.01); *F04D 29/52* (2013.01); *F04D 29/522* (2013.01); *F04D 29/54* (2013.01); *F04D 29/542* (2013.01); *F04D 29/64* (2013.01); *F04D 29/644* (2013.01)

(58) Field of Classification Search
CPC ..... F04D 29/644; F04D 29/522; F04D 29/02; F04D 29/52; F04D 29/54; F04D 29/64
See application file for complete search history.

(56) References Cited

U.S. PATENT DOCUMENTS

| | | | | |
|---|---|---|---|---|
| 6,953,317 | B2 * | 10/2005 | Ikegami | F04D 27/008 415/9 |
| 7,824,153 | B2 * | 11/2010 | Akimoto | F04D 29/542 415/191 |
| 2001/0016160 | A1 * | 8/2001 | Ikegami | F04D 27/008 415/90 |
| 2004/0156715 | A1 | 8/2004 | Maniglier | |
| 2008/0118351 | A1 * | 5/2008 | Akimoto | F04D 29/542 415/191 |
| 2011/0064562 | A1 | 3/2011 | Oishi | |

FOREIGN PATENT DOCUMENTS

| | | | |
|---|---|---|---|
| CN | 101432525 | A | 5/2009 |
| CN | 101842597 | A | 9/2010 |
| CN | 102918278 | A | 2/2013 |
| CN | 103261698 | A | 8/2013 |
| CN | 104421171 | A | 3/2015 |
| CN | 105579711 | A | 5/2016 |
| DE | 9013672 | U1 | 1/1992 |
| DE | 19937393 | A1 | 2/2001 |
| EP | 0568069 | A2 | 11/1993 |
| EP | 0703368 | A2 | 3/1996 |
| EP | 0887556 | A1 | 12/1998 |
| EP | 0965761 | A2 | 12/1999 |
| EP | 1795756 | A1 | 6/2007 |
| EP | 2607706 | A2 | 6/2013 |
| JP | 3399800 | B2 | 4/2003 |
| WO | 0111242 | A1 | 2/2001 |
| WO | 0186158 | A1 | 11/2001 |

OTHER PUBLICATIONS

PCT Notification of Transmittal of the International Search Report and the Written Opinion of the International Searching Authority, or the Declaration dated Nov. 7, 2017, PCT Search Report and Written Opinion dated Nov. 7, 2017 for corresponding PCT Application No. PCT/GB2017/052244.
Harris, Turbomolecular Pumps, Modern Vacuum Practice, Mc-Graw-Hill, Chapter 9, Third Edition, pp. 232-256, 2007.
First Office Action dated Apr. 27, 2020 for corresponding Chinese application Serial No. CN201780062265.6, 20 pages.

* cited by examiner

VACUUM PUMP

CROSS-REFERENCE OF RELATED APPLICATION

This application is a Section 371 National Stage Application of International Application No. PCT/GB2017/052244, filed Aug. 2, 2017, and published as WO 2018/029446 A1 on Feb. 15, 2018, the content of which is hereby incorporated by reference in its entirety and which claims priority of British Application No. 1613576.6, filed Aug. 8, 2016.

FIELD

This invention relates to vacuum pumps. In particular, the invention relates to improvements in turbo-molecular vacuum pumps. Specifically, the invention relates to a pump stator configured for use in a turbo-molecular vacuum pump.

BACKGROUND

Turbo-molecular vacuum pumps are well known to the person skilled in the art. Such pumps are designed to operate to evacuate a chamber to high vacuum pressures of approximately $10^{-6}$ mbar and below, where gas molecules exhibit molecular flow regime behaviour. In such a rarefied environment, gas molecules do not typically interact with one another, rather the molecules interact with the walls of the chamber and exhibit extremely long mean free paths compared to gas molecules at pressures closer to atmospheric pressure.

Typically, such pumps comprise a mechanism having a housing arranged to accommodate the pump's components, including a rotor, stator, drive shaft, bearings and motor. The housing has an inlet to allow gas molecules to enter the pump, where the gas is compressed by the pump mechanism. The compressed gas is then passed to an outlet where it exits the turbo-molecular pump and typically onto another vacuum pump arrange to operate in lower vacuum pressures, closer to atmospheric pressure.

Turbo-molecular rotor and stator components comprise a series of angled blade arrays where neighbouring rotor blades are interposed by a similar stator blade array. Thus, a blade stack is arranged where each rotor blade array is followed by a stator blade array, as described in Chapter 9 of "Modern Vacuum Practice"; Third Edition, by Nigel Harris, published by McGraw-Hill in 2007 (ISBN-10: 0-9551501-1-6). Stator components typically comprise an array of stator blades, arranged to interact with the pumped gases, mounted on an inner and/or outer diameter hub or shoulder. They can be machined from a solid metal block or pressed from sheet metal.

The stator blade arrays are typically formed as separate components that are located between each rotor blade array (or stage). Spacers are used to locate the stator blade array (or stage) correctly between rotor stages. Typically, a stack of stator components is formed by alternately placing stator blades and spacers in the stack. A spring washer is placed between one end of the stack and the pump housing to ensure that the spacers are held in position and urged together by a force applied longitudinally through the stack by the spring washer. The force applied by the spring washer acts to reduce movement of the stator stages relative to the rotor during operation. A further example of this arrangement can be found in U.S. Pat. No. 5,052,887. Alternatively, the spring washer can be located in a central position in the spacer stack, as described in EP2607706.

The stator can be arranged such that the stator blades extend radially from an inner portion to an outer portion. The outer portion can be arranged to form a spacer means, as described in WO01/11242. Furthermore, a bearing disposed at the pump's inlet is typically supported by a so-called bearing spider arrangement that can be configured to cooperate with the stator spacing means, as shown in EP1281007.

There is a general desire to reduce the number of pump components, thereby simplifying the manufacturing process and improving mechanical tolerances.

The discussion above is merely provided for general background information and is not intended to be used as an aid in determining the scope of the claimed subject matter. The claimed subject matter is not limited to implementations that solve any or all disadvantages noted in the background.

SUMMARY

The present invention, in broad terms, is directed towards a turbo-molecular pump having a series of stator components stacked between spacers to correctly locate the stator components in the pump's housing. At least one of the stator components has an outer section that is resilient and, as a result, this resilient outer section applies a spring load when under compression between adjacent spacers such that the stator component is held in place during pump manufacture and operation.

This arrangement has several advantages, in that it reduces the number of components needed to make a pump because the spring washer used in a conventional prior art pump is no longer required. The accuracy with which the stator components can be located in the housing can also be improved. The stator components are held firmly during operation, reducing the risk of the component rattling within the confines of the spacers.

Accordingly, there is provided a turbo-molecular vacuum pump comprising: a housing for accommodating rotor and stator components of the turbo-molecular vacuum pump having an inlet side and an outlet side, a drive shaft coupled to the rotor components for driving the rotor components around a longitudinal axis, bearing means for coupling the drive shaft to the housing and to allow relative rotary movement thereof, and a spacer for locating and coupling the stator components relative to the housing; wherein each of said stator components comprises a series of stator blades extending radially from the longitudinal axis and between an inner portion to an outer portion, each of the stator blades being angled with respect to a plane defined by the inner portion, characterised in that the outer portion of at least one of the stator components comprises a resilient portion arranged to cooperate with the spacer. As a result, the resilient outer portion of the stator component effectively replaces a spring washer that is used in conventional turbo-molecular pumps.

The resilient portion can comprise a compliant section disposed at the ends of the stator blades. Furthermore, the compliant section can comprise an outer tip of the stator blade, integrally formed with and extending an end of the stator blade. Further still the outer tip of the stator blade can be an extension of the stator blade arranged to extend into a space between adjacent spacers, such that an outer diameter of the stator component is greater than an inner diameter of the spacer. Thus, the present invention can use the angled stator blades as spring members that are deformed by the spacer rings compressing the blade tips. A stator stack can comprise a plurality of spacers each being interposed between adjacent stator components and, when located in the pump housing, a securing means secures the stator stack in a position and compresses the respective resilient portions. Thus, the spacers are urged together by the securing means, which can comprise a threaded element cooperating with a threaded portion of the pump housing.

Each of the outer portions of the stator components can provide all of the resilience between the spacer and the housing. Thus, the need for a spring washer is negated. Accordingly, when a compression force is applied by the securing means to the stator stack the compression force causes the outer tip of the stator blades to move from a relaxed position to a flattened position relative to a radial axis of each blade. A force applied to the spacers by the outer tips of the stator blades when in the flattened position has an equal magnitude to the compression force. The force applied by the outer tips is in the opposite direction to the compression forces.

A stator blade array for a turbo-molecular vacuum pump, comprising a series of stator blades extending radially from an inner portion to an outer portion, each of the stator blades being angled with respect to a plane defined by the inner portion, characterised in that the outer portion of the stator blade array comprises a resilient portion arranged to cooperate with a spacing ring or a housing of a turbo-molecular pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1:
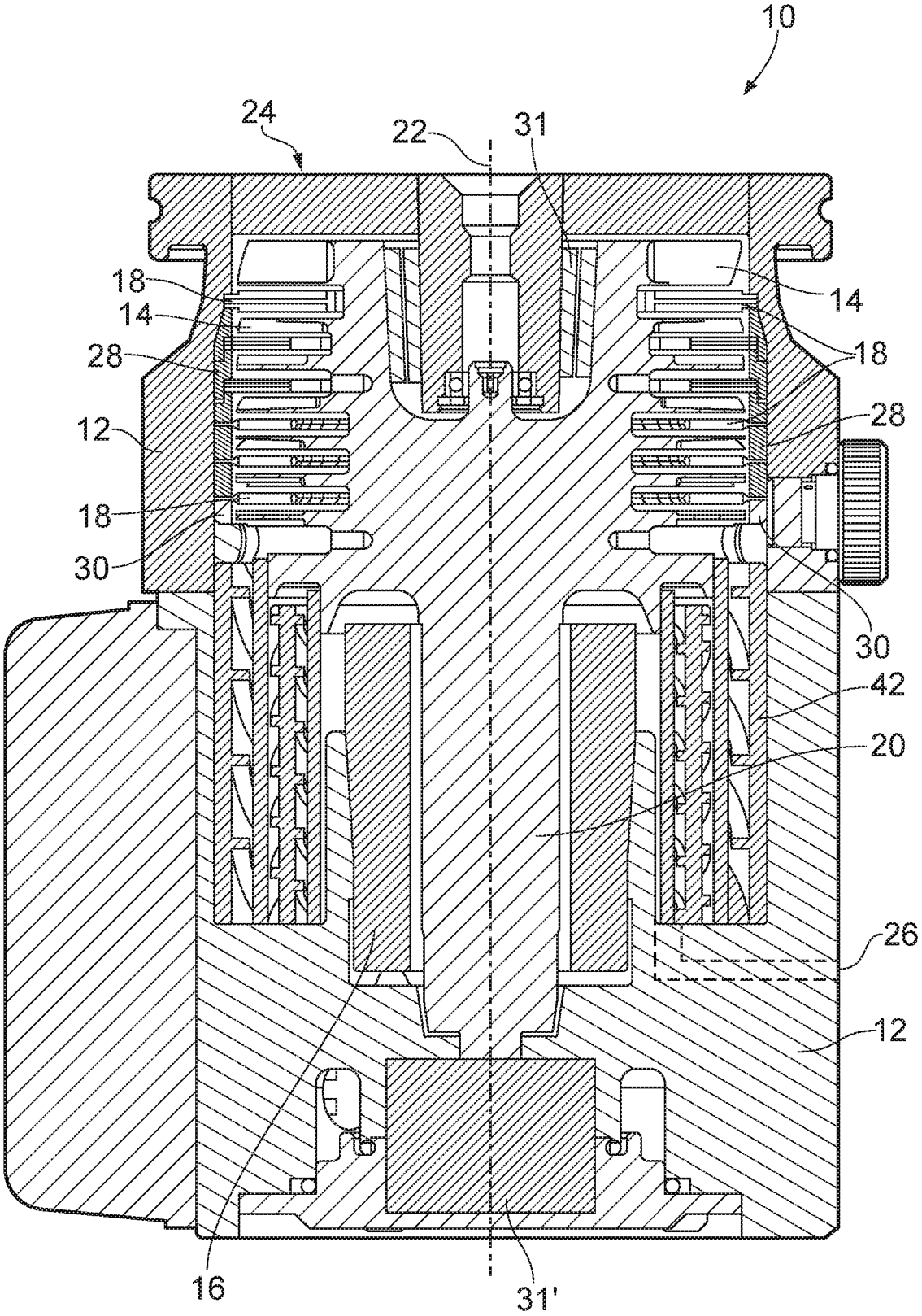
FIG. 1 is a schematic diagram of a section of a pump embodying the present invention.

Referring to FIG. 1, a turbo-molecular pump 10 comprises a housing 12 for accommodating pump rotor 14, motor 16 and stator 18 is provided. The rotor is coupled to the motor via a drive shaft 20 for rotation about an axis 22. The stator 18 is mounted in the housing such that the stator blades and rotor blades are arranged alternately as gas molecules pass through the pump from an inlet 24 to an outlet 26.

Both the rotor and stator comprise a series of stages, with the rotor comprising a series of blade arrays extending along the axis in a longitudinal direction. Sufficient space between adjacent rotor stages is arranged to accommodate a stator blade array. The rotor blade array comprises a series of blades extending radially from a central hub wherein the blades are angled with respect to the longitudinal axis about which the rotor rotates when driven by the motor. The stators comprise similar blades that are angled in the opposite direction to the rotor blades and the stator component is coupled to, and held in place by, the housing.

The housing accommodates the stator components by coupling an outer diameter rim of the stator to the housing via spacers 28 and a securing means 30 to secure the stator components in position. Typically, the stator components are stacked with alternating spacers that provide sufficient gap between the stator blade arrays to accommodate the rotor blades. Bearings 31 and 31' are positioned at either end of the drive shaft 20 to allow the drive shaft, and hence the rotor, to rotate within the housing 12 during normal pump operation. The bearing 31 on the inlet side of the pump can comprise a magnetic bearing, as shown in FIG. 1. The bearing 31' on the outlet side is typically comprised of an oil lubricated roller bearing and oil reservoir. Alternatively, greased bearing systems can be used.

Figure 2:
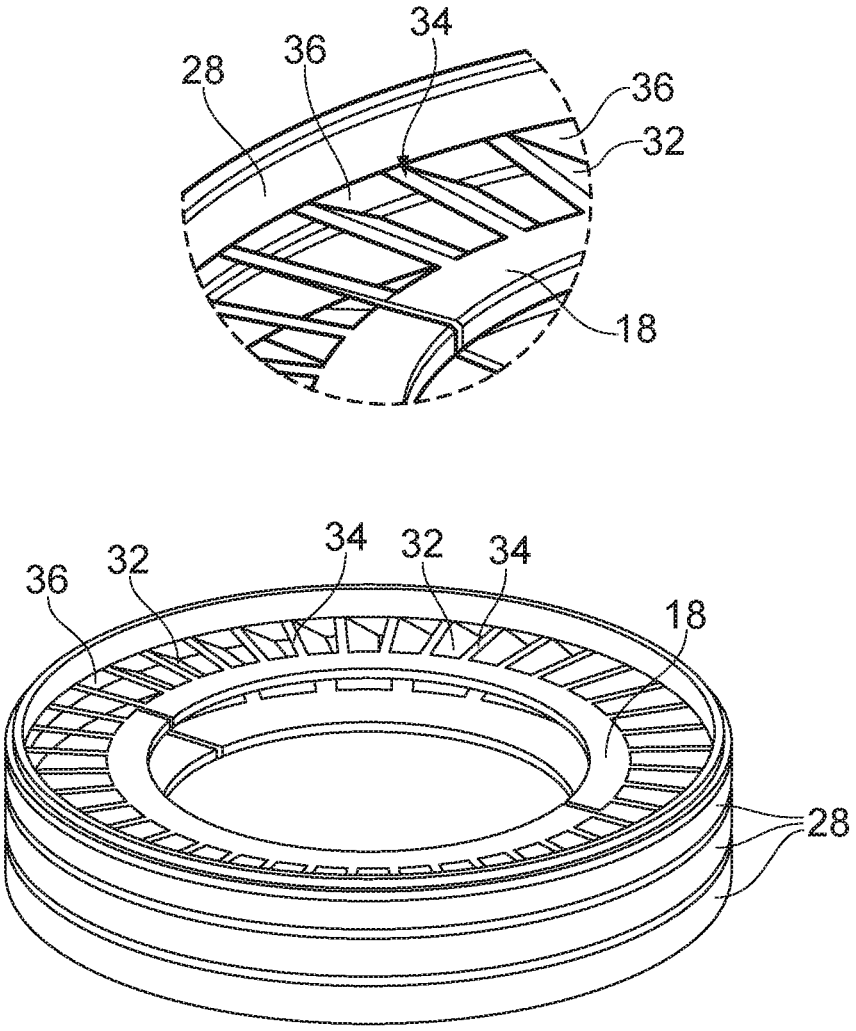
FIG. 2 is a schematic diagram of a portion of the pump shown in FIG. 1.
Figure 3:
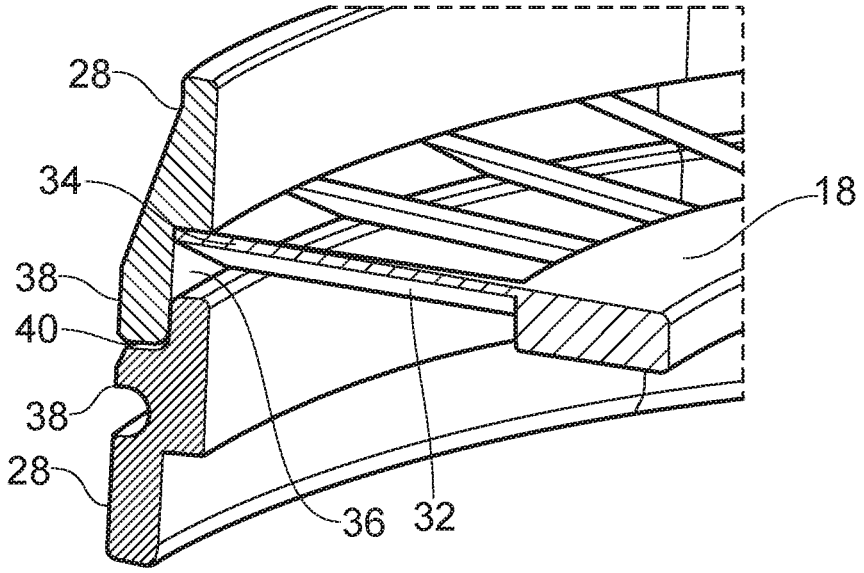
FIG. 3 is a cross-sectional diagram of a portion of the pump shown in FIG. 1.

A spring is required to urge the components of the stator stack into a desired position and to maintain this position during normal operation of the pump. Referring to FIGS. 2 and 3, the present invention utilises the stator blades 32 to provide the spring force. By providing the outer radial tips 34 of the stator with a degree of flexibility, the resulting resilience of the tips apply a spring force when they are under compression due to a twisting moment applied to the tips under compressive force when applied in an axial direction.

The spacer rings 28 are designed to interlock with one another and retain the stator 18 in an axial gap 36 formed between the spacers. The outer diameter of the stator blades (including the blade tips) is greater than the inner diameter of the spacer, thereby forming an overlap between the stator blade and spacer, such that the stator blade tips extend between adjacent spacers. By making the gap between spacers slightly smaller than the axial height of the stator blades 32, the blade tips 34 are compressed and twisted between the spacers as the securing means is tightened and the gap 36 between spacers reduces. The compressive force applied to the outer tips 34 of the stator blades 32 causes the blade tips 34 to twist from a natural position towards a flattened position. As a result, the tips of the blades are acting as a torsion spring applying a spring force to the spacers.

The spacers 28 can be provided with stops 38 to prevent over-compression of the stator blade tips. For example, an external predefined gap 40 can be provided between adjacent washers. The external gap can be arranged to be in the order of 200 microns when a stator is disposed between the spacers. Thus, when the external gap is closed under compression, so the stator blades have become compressed by a 200 micron distance. In this way, the maximum compressive force applicable to the stator blade tips can be determined. It is advisable that the compressive force applied to the stator blades does not exceed the spring constant of the blade tips to avoid permanent deformation of the stator blade tips.

In the embodiment shown in FIG. 1 there is a total of six stator stages in the pump prior to a Holweck pump mechanism 42 downstream of the turbo-molecular stages and upstream of the outlet 26. Three of the stator stages comprise conventional pressed stator components, wherein the outer diameter of the stator comprises a relatively thin sheet of metal from which the stator blades are pressed. These stator stages are located on the outlet side of the turbo-molecular pump mechanism. The three stator stages located on the inlet side each have the stator blade tips located in the gap between the associated spacer rings. Thus, in this arrangement half of the stator blades are arranged to provide a spring force to the stator stack when it is secured in the housing.

In addition, it is possible to reduce the dimensions of the stator blade at the blade tip. This can provide a flex-point at which the stator blade twists when the compressive force is applied by the securing means 30. The reduced dimension of the stator blade tip can be sized such that the stator component is held securely between adjacent spacers as a result of shoulder formed at the point where the dimension of the stator tip reduces engaging with an inner diameter of the stator ring, or with a cooperative shoulder formed on the housing. This arrangement is shown in FIG. 1, where the stator blade tip at the inlet of the pump is shown to have a reduced dimension in the axial direction at the point where the blade tip engages with the associated spacer and housing.

A securing means can be provided by a threaded system or an appropriate C-click. Other types of securing are envisaged by the skilled person without departing from the scope of the invention.

The present invention utilises the stator blade tips to provide a spring force when the tip are compressed between spacer rings. Thus, there is no longer a need to use a spring washer to compress maintain the stator stack in position, thereby reducing the number of components in the pumps and simplifying the assembly process. All the spring force required to maintain the stator stack in position is provided by the stator blade tips.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A turbo-molecular vacuum pump comprising:

a housing for accommodating rotor and stator components of the turbo-molecular vacuum pump having an inlet side and an outlet side, a drive shaft coupled to the rotor components for driving the rotor components around a longitudinal axis, bearing means for coupling the drive shaft to the housing and to allow relative rotary movement thereof, and a first spacer located on a first side of a first stator component of the stator components;

a second spacer located on a second side of the first stator component;

wherein the first stator component comprises a series of stator blades extending radially from the longitudinal axis and between an inner portion to an outer portion, each of the stator blades being angled with respect to a plane defined by the inner portion, wherein the outer portions of the stator blades of the first stator component each comprises a resilient portion arranged to contact the first spacer and the second spacer so as to provide a gap between a stop of the first spacer and a stop of the second spacer before the first spacer and the second spacer are under compression and to provide a spring load when the first spacer and the second spacer are under compression wherein the stop of the first spacer and the stop of the second spacer prevent the resilient portion from being permanently deformed by the first spacer and the second spacer when the gap is removed while the first spacer and the second spacer are under compression.

2. The turbo-molecular vacuum pump according to claim 1, wherein the resilient portion comprises a compliant section disposed at the ends of the stator blades.

3. The turbo-molecular vacuum pump according to claim 2, wherein the compliant section comprises an outer tip of the stator blade, integrally formed with and extending an end of the stator blade.

4. The turbo-molecular vacuum pump according to claim 3, wherein when the first spacer and the second spacer are under compression, the outer tips of the stator blades move from a natural position to a flattened position relative to a radial axis of each blade.

5. The turbo-molecular vacuum pump according to claim 4, wherein the spring load provided by the outer tips of the stator blades when in the flattened position has an equal magnitude to a compression force required to remove the gap.

6. The turbo-molecular vacuum pump according to claim 1, further comprising a securing means that places the first spacer and the second spacer under compression.

7. The turbo-molecular pump according to claim 1, wherein each of the outer portions of the stator components provide all of the resilience between the spacer and the housing.

8. A stator blade array for a turbo-molecular vacuum pump, comprising a series of stator blades extending radially from an inner portion to an outer portion, each of the stator blades being angled with respect to a plane defined by the inner portion, characterised in that the outer portion of the stator blade array comprises a resilient portion arranged to contact a first spacer and a second spacer so as to provide a gap between a stop of the first spacer and a stop of the second spacer before the first spacer and the second spacer are under compression and to provide a spring load when the first spacer and the second spacer are under compression wherein the stop of the first spacer and the stop of the second spacer prevent the resilient portion from being permanently deformed by the first spacer and the second spacer when the gap is removed while the first spacer and the second spacer are under compression.

* * * * *